United States Patent [19]

Ungarean et al.

[11] Patent Number: 4,469,165

[45] Date of Patent: Sep. 4, 1984

[54] ELECTROMAGNETIC EDGE CONTROL OF THIN STRIP MATERIAL

[75] Inventors: Gary L. Ungarean, Woodbridge; John C. Yarwood, Madison, both of Conn.

[73] Assignee: Olin Corporation, New Haven, Conn.

[21] Appl. No.: 386,132

[22] Filed: Jun. 7, 1982

[51] Int. Cl.[3] ..... B22D 27/02

[52] U.S. Cl. ..... 164/467; 164/503

[58] Field of Search ..... 164/467, 503

[56] References Cited

U.S. PATENT DOCUMENTS

| | | | |
|---|---|---|---|
| 3,463,365 | 8/1969 | Dumont-Fillon | 164/446 |
| 3,467,166 | 9/1969 | Getselev et al. | 164/467 |
| 3,605,865 | 9/1971 | Getselev | 164/503 |
| 3,947,533 | 3/1976 | Davis | 164/467 |
| 3,985,179 | 10/1976 | Goodrich et al. | 164/503 |
| 4,004,631 | 1/1977 | Goodrich et al. | 164/503 |
| 4,033,398 | 7/1977 | Laithwaite | 164/467 |
| 4,161,206 | 7/1979 | Yarwood et al. | 164/467 |
| 4,215,738 | 8/1980 | Gaule et al. | 164/467 |
| 4,319,625 | 3/1982 | Kindlmann et al. | 164/467 |
| 4,321,959 | 3/1982 | Yarwood et al. | 164/467 |
| 4,358,416 | 11/1982 | Yarwood et al. | 164/467 |

FOREIGN PATENT DOCUMENTS

| | | |
|---|---|---|
| 1481301 | 7/1977 | United Kingdom . |
| 1499809 | 1/1978 | United Kingdom . |
| 2009002 | 6/1979 | United Kingdom . |

OTHER PUBLICATIONS

National Technical Information Service Report PB-248963, "Scale Up of Program on Continuous Silicon Solar Cells" by A. D. Morrison, Sep., 1975.

"The Role of Surface Tension in Pulling Single Crystals of Controlled Dimensions", by G. K. Gaule et al., *Metallurgy of Elemental and Compound Semiconductors*, published by Interscience Publishers, Inc., New York, 1961, pp. 201-226.

*Primary Examiner*—Kuang Y. Lin

*Assistant Examiner*—Richard K. Seidel

*Attorney, Agent, or Firm*—Howard M. Cohn; Paul Weinstein; Barry L. Kelmachter

[57] ABSTRACT

An apparatus and process are provided for forming molten thin strip material into a desired thin strip shape. The apparatus comprises a device for electromagnetic forming of the molten material. This device includes a first and second inductor disposed on either side of the molten thin strip material for generating first and second magnetic fields about the first and second edges of the thin strip material. Third and fourth inductors are disposed adjacent opposite edges of the thin strip material for generating third and fourth magnetic fields which interact with the first and second magnetic fields, respectively. Structure regulates the strength of the fields induced by the inductor device to form the molten material into the desired thin strip shape.

17 Claims, 6 Drawing Figures

ELECTROMAGNETIC EDGE CONTROL OF THIN STRIP MATERIAL

While the invention is subject to a wide range of applications, it is especially suited for use in electromagnetic casting of strip material and will be particularly described in that connection. The process and apparatus are preferably used to overcome the surface tension effects which occur during the shaping of thin semiconductor ribbon in the molten state.

It is believed, while electromagnetically casting or reforming thin strip semi-conductive materials, the tendency for surface tension forces to distort the shape of the molten material being formed into a thin strip may be a major problem. The problem results in poor, irregular shape control of the thin strip. The present invention substantially eliminates this problem and thereby provides consistency in the geometry of uniform thin strip material.

A variety of processes have been developed for forming semi-conductive materials such as silicon into a thin strip shape. Examples of such approaches can be found in National Technical Information Service Report PB-248963, "Scale Up of Program on Continuous Silicon Solar Cells" by A. D. Morrison, published in September 1975, and a paper entitled "The Role of Surface Tension in Pulling Single Crystals of Controlled Dimensions" by G. K. Gaule et al. from *Metallurgy of Elemental and Compound Semiconductors,* published by Interscience Publishers, Inc., New York in 1961, pages 201–226. The Morrison publication is exemplary of the state of the art with respect to the pulling of strip-type materials from a melt of silicon. The Gaule et al. publication is similarly exemplary and of particular interest insofar as it discloses the use of electromagnetic forces for applying external pressure at the growth interface.

In U.S. Pat. No. 4,353,408 by M. J. Pryor, an electromagnetic thin strip casting apparatus and process are described which are adapted for forming thin strip castings of a variety of materials including semi-conductive materials such as silicon. In this apparatus, a specially-shaped inductor is utilized for containing a funnel-shaped pool of molten material and for forming the material into the desired thin strip shape. The process can be carried out continuously or semi-continuously as desired.

U.S. Pat. No. 4,419,177 by Pryor et al. discloses, for example, "a process and apparatus for electromagnetically containing and forming molten material into a desired thin strip shape. At least two inductors are employed which are powered at respectively different frequencies. The frequency of the current applied to the upstream inductor is substantially lower than the frequency applied to the downstream inductor thereby providing improved efficiency and reduced power consumption."

U.S. Pat. No. 4,356,861 by Winter discloses, for example, "an apparatus and process for recrystallization of thin strip material includes a device for electromagnetically melting the thin strip material to provide a molten surface layer and a substantially solid core. Apparatus provides relative movement between the thin strip and the device for electromagnetically melting. Also, an apparatus resolidifies the molten surface layer to provide a preferred crystal structure in the thin strip material."

A considerable body of art has developed with respect to the use of electromagnetic containment for the purposes of casting metals. These electromagnetic casting apparatuses comprise a three-part mold consisting of a water cooled inductor, a non-magnetic screen, and a manifold for applying cooling water to the resultant casting. Such an apparatus is exemplified in U.S. Pat. No. 3,467,166 to Getselev et al. Containment of the molten metal is achieved without direct contact between the molten metal and any component of the mold. Solidification of the molten metal is attained by the direct application of water from a cooling manifold to the solidifying shell of the casting. An elaborate discussion of the prior art relating to electromagnetic casting is found in U.S. Pat. No. 4,161,206 to Yarwood et al. That prior art statement is intended to be incorporated by reference herein. The Yarwood et al. patent deals with a control system for controlling the electromagnetic process which is believed to have particular use in the apparatus of the present invention.

Non-magnetic screens of the prior art are typically utilized to properly shape the magnetic field for containing the molten metal as exemplified in U.S. Pat. No. 3,605,865 to Getselev. This patent teaches the provision of an electromagnetic screen with upwardly directed thickening so that the rate of attenuation of the magnetic field of the inductor is increased upwardly. This reference neither considers nor prevents the problem of surface tension because the ingots of molten metal being formed are sufficiently large to inherently substantially overcome this problem.

Another approach with respect to use of non-magnetic screens is exemplified in U.S. Pat. Nos. 3,985,179 and 4,004,631 to Goodrich et al. The '179 reference describes the use of a shaped inductor in conjunction with a screen to modify the electromagnetic forming field so that a gradually diminishing flux density is provided whereby the radial forces on the molten metal surface are gradually reduced toward the upper portion of the molten metal column to maintain the vertical surfaces of the molten metal essentially straight. This reference is not concerned with effects of surface tension because the ingot of molten metal is sufficiently large to override this consideration. The '631 reference is directed to an electromagnetic inductor provided with a coolant jacket which directs coolant onto the metal being cast.

U.S. Pat. No. 4,215,738 to Gaule et al. discloses, for example, "electromagnetic casting of metals and alloys utilizing anti-parallel inductors which are placed between the main inductor and the ingot being cast."

U.S. Pat. No. 4,319,625 to Kindlmann et al. discloses, for example, "an electromagnetic casting process and apparatus utilizing an active transformer-driven copper shield. The shield is actively driven with a voltage out of phase with the voltage in the containment inductor with the result that a bucking current is produced in the shield which is out of phase with the current induced in the shield by the inductor."

U.S. Pat. No. 4,321,959 to Yarwood et al. provides a non-magnetic shield used in conjunction with an inductor to eliminate undesirable rounding-off of the corners of the molten metal in the casting zone. The control or shaping of the magnetic field by differential screening may also be accomplished by contouring the inductor. In either case, the effect on the molten metal is at its corners and is not concerned with the surface tension which only has significant effects in thin strips of molten material.

A shaped inductor for molding molten material is disclosed in U.K. patent application No. 2,009,002 to Swiss Aluminum, Ltd. This reference teaches the concept of reducing the vertical dimension of an inductor of constant thickness in order to raise the current density in the inductor and the magnetic field strength at the location of reduced dimension. The aim of this invention is to produce ingots having a convex shape in the side walls whereby the shrinkage caused by the cooling of the ingots results in flat surfaces. This reference differs from the present invention in that it is concerned with the casting of rectangular metal ingots which are too large to notice any significant effect due to surface tension.

U.S. Pat. No. 3,463,365 to Dumont-Fillon and British Pat. No. 1,481,301 are exemplary of the art relating to the use of electromagnetic fields for controlling metal flow from a tundish or crucible into a mold. In the British patent, an electromagnetic field is not only used to control the flow of molten metal from the crucible but also to keep the molten metal from flowing against the refractory of a portion of the crucible to thereby reduce erosion of the refractory. In the British '301 patent, the crucible is relatively large in diameter as compared to the opening or nozzle through which the molten metal exits the crucible and is supplied to the mold.

In British Pat. No. 1,499,809, a rod casting system is provided utilizing a crucible and electromagnetic flow control arrangement similar to that described in the previous '301 British patent. However, in this case the electromagnetic coil which controls metal flow also serves to shape the metal into the desired rod shape which is then cooled with water to solidify it and rolled into a final desired rod or wire product.

U.S. patent application Ser. No. 213,125 filed Dec. 4, 1980 (now abandoned) by Yarwood et al. discloses, for example, "an apparatus and process for electromagnetically forming a material into a desired thin strip shape. The apparatus comprises a first portion for electromagnetically containing and forming the material in molten form into a cross-sectional shape substantially the same as the desired thin strip shape. A second portion receives the molten material in thin strip shape from the first portion. In addition, the second portion reduces the distortion in the cross-sectional shape due to surface tension. The second portion includes a device for providing an electromagnetic field having a reduced strength as compared to the strength of an electromagnetic field in the first portion. The electromagnetic field may be reduced in strength by providing an inductor having hollow inner surfaces facing the molten material so as to form substantially straight vertical surfaces in the molten material. In another embodiment, a shield is provided between the inductor and the molten metal to selectively reduce the strength of the electromagnetic field."

U.S. Pat. No. 4,033,398 to Laithwaite discloses, for example, "a layer of metal is cast on a surface of a metal backing and while the cast metal is still molten, a varying electromagnetic force is generated along an edge of the strip which induces electric currents in the molten metal. The resulting mechanical force exerted in the molten metal is such that the metal is restrained from flowing to the edge of the strip."

It is a problem underlying the present invention to provide shape control of molten thin strip material.

It is an advantage of the present invention to provide an apparatus and process for forming a material into a thin strip shape which substantially obviates one or more of the limitations and disadvantages of the described prior arrangements.

It is a further advantage of the present invention to provide an apparatus and process for electromagnetically forming a material into a desired thin strip which reduces the distortion in the cross-sectional shape due to surface tension.

It is a still further advantage of the present invention to provide an apparatus and process for electromagnetically forming a material into a desired thin strip shape which controls the electromagnetic field strength at the edges for reducing the distortion in the cross-sectional shape of the thin strip.

It is a yet further object of the present invention to provide a process and apparatus for electromagnetically forming a material into a desired thin strip shape in a manner which is relatively inexpensive to manufacture and operate.

Accordingly, there has been provided an apparatus and process for forming molten thin strip material into a desired thin strip shape. The apparatus comprises a device for electromagnetic forming of the molten material. This device includes a first and second inductor disposed on either side of the molten thin strip material for generating first and second magnetic fields about the first and second edges of the thin strip material. Third and fourth inductors are disposed adjacent opposite edges of the thin strip material for generating third and fourth magnetic fields which interact with the first and second magnetic fields, respectively. Structure regulates the strength of the fields induced by the inductor devices to form the molten material into the desired thin strip shape.

For a better understanding of the present invention, together with other and further objects thereof, reference is had to the following description, taken in connection with the accompanying drawings, while its scope will be pointed out in the appended claims.

Figure 1:
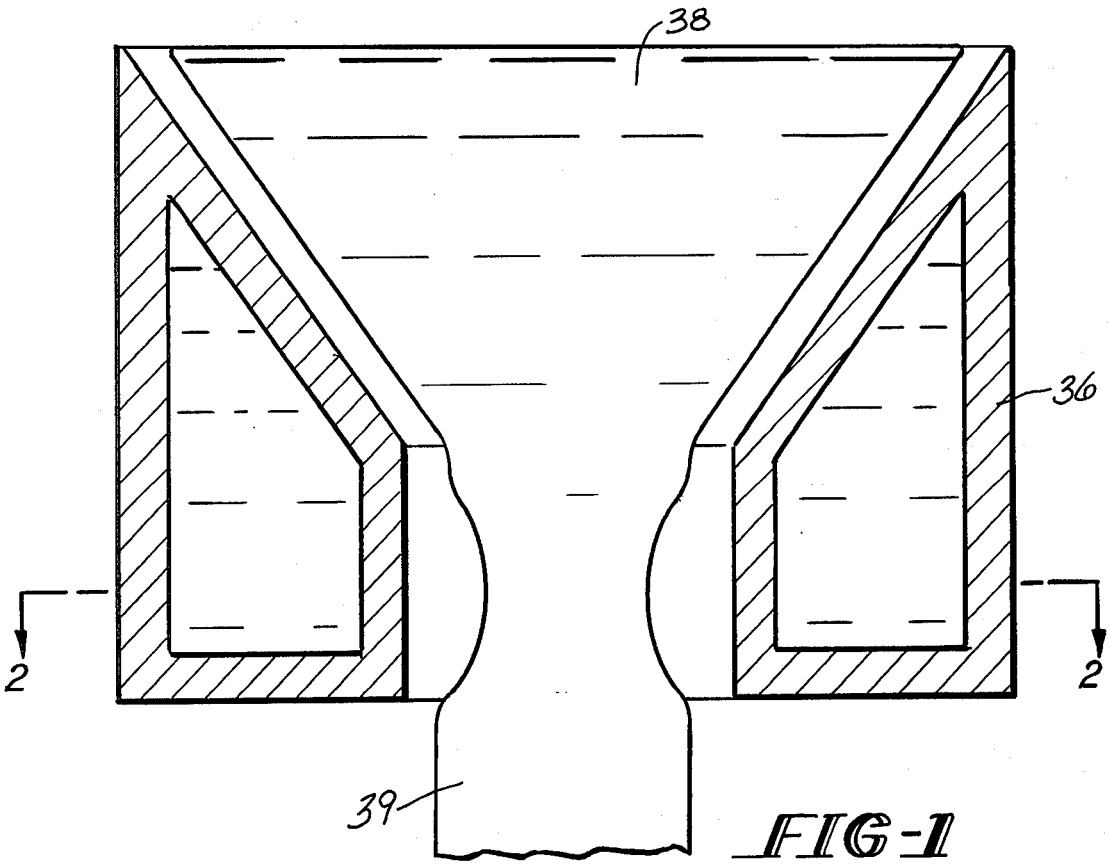
FIG-1 PRIOR ART
FIG. 1 is a schematic side view illustrating the problem of casting in accordance with the prior art.

An apparatus 10 is provided for forming molten thin strip material 12 into a desired thin strip shape 14. The apparatus comprises a device 16 for electromagnetic forming of the molten material. This device includes first and second inductors 18 and 20 disposed on either side 22, 24 of the molten thin strip material for generating first and second magentic fields about the first and second edges 26 and 28 of the thin strip material. The device 16 also includes third and fourth inductors 30 and 32 disposed adjacent opposite edges of the molten thin strip material for generating third and fourth magnetic fields which interact with the first and second magnetic fields, respectively. A control device 34 regulates the strength of the fields induced by the inductors to form the molten material into the desired thin strip shape 14.

Figure 2:
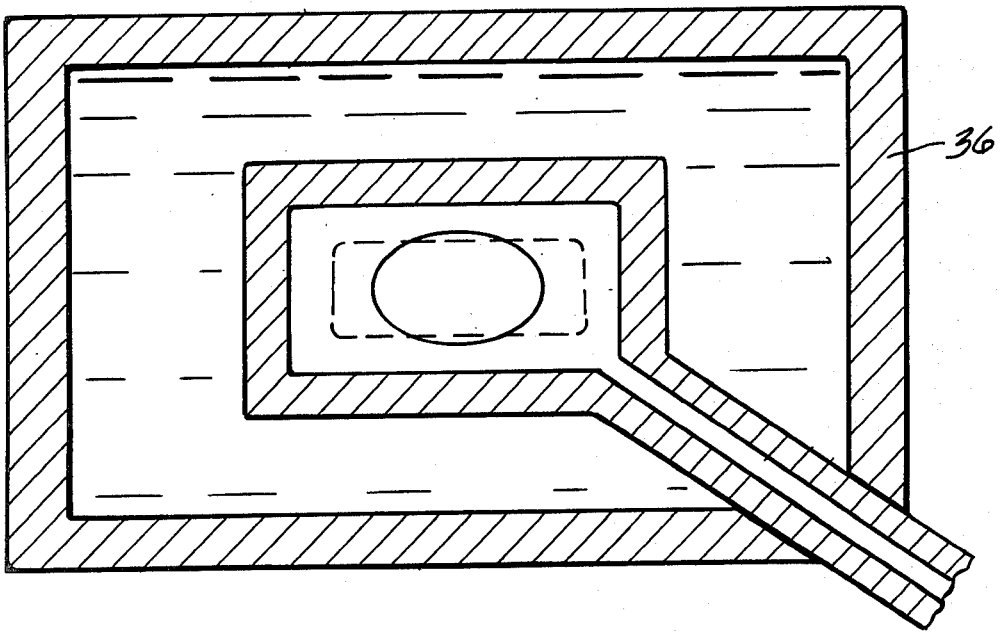
FIG-2 PRIOR ART
FIG. 2 is a view through 2—2 of FIG. 1.

Referring to FIGS. 1 and 2, there is shown a schematic of a prior art system for electromagnetic casting of thin silicon ribbon from a melt as more fully described in the above-mentioned Pryor Pat. No. 4,353,408. This system includes a shaped inductor 36 supporting a large sump 38. The inductor provides an electromagnetic force to form the molten material into a thin strip 39. One major problem encountered in this technique for electromagnetically casting silicon is the tendency for surface tension forces to minimize the large surface area to volume ratio of the liquid metal being formed and cast. The surface tension tends to shrink the long transverse direction of the strip to form a section which is first elliptical or ovoid, then circular and possibly even nipped off entirely. FIG. 2 illustrates the tendency of the molten material 40, due to surface tension, to begin necking down from the formed thin strip shown in dotted lines to the ovoid shape in solid lines. The material may continue to neck down until it entirely pinches off. The large molten material sump 38 creates a substantial pressure head which counteracts the tendency of the surface tension to neck down the strip. Howver, when the molten material enters the section of the electromagnetic field, where it is formed into a desired thin strip shape, the electromagnetic force acts in conjunction with surface tension forces to cause the tendency of necking down. The present invention is primarily used in the formation of thin strip shaped material 39 having a thickness of approximately 0.1" or less where the problem of surface tension is particularly pronounced. In somewhat thicker or larger sized ingots of material, the problem of surface tension is less pronounced and may be negligible because of the relatively stronger effects of pressure head and gravity.

Figure 3:
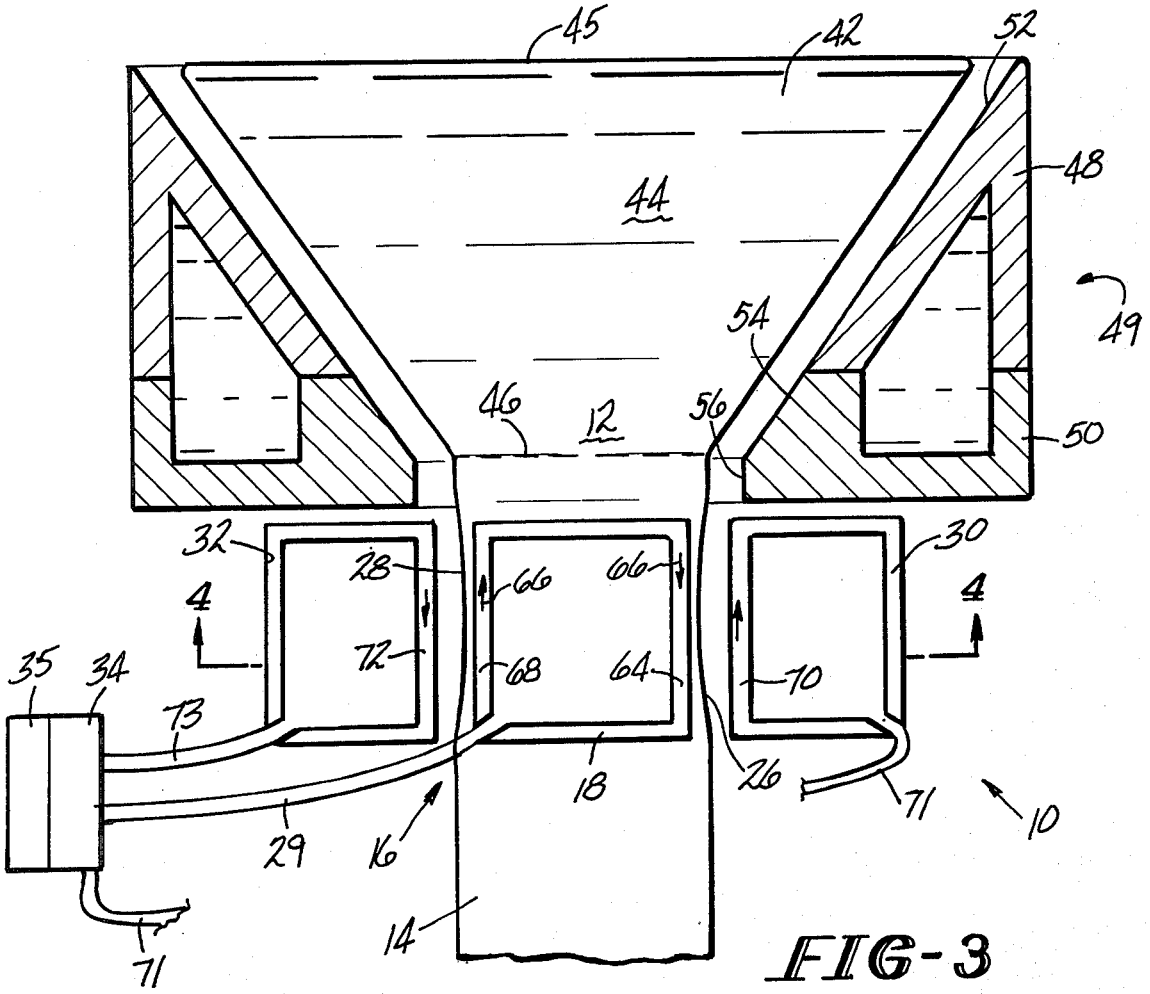
FIG. 3 is a schematic illustration of a side view of the present invention.
Figure 4:
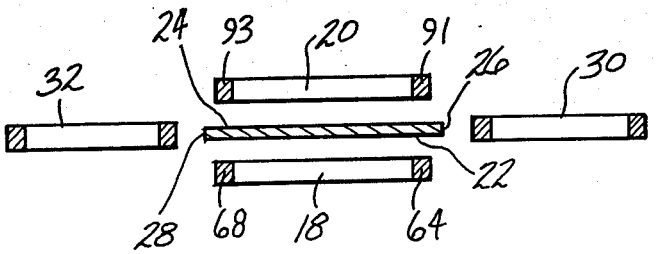
FIG. 4 is a view through 4—4 of FIG. 3.

Referring to FIGS. 3 and 4, there is shown a preferred embodiment of the present invention. A large sump 42 of molten material 44, such as for example silicon, may be provided. The sump 42 has a non-uniform cross section and flares out to create a top surface 45 of the molten material with a substantially larger cross-sectional area as compared to the cross-sectional area of a bottom surface 46 thereof. Preferably, the top surface has a cross-sectional area at least about five times as large as the cross-sectional area of the bottom surface and most preferably at least seven times larger. Note that the bottom surface 46 of the molten material has substantially the cross section of the thin strip shape 14.

The provision of a large sump in the present apparatus has a number of advantages. The sump contains a sufficiently large volume of molten material to insure the melting of additional material being fed into the sump without the creation of any significant temperature differentials. Also, the ability to control the temperature more precisely prevents premature solidification of the molten material in the apparatus. The large volume of molten material in the sump creates a larger hydrostatic pressure head which tends to reduce the problems with the surface tension as mentioned above. The height of the sump can be more easily controlled due to its larger volume whereby the hydrostatic pressure can be maintained substantially constant. Further, the flow of molten material from the sump can be precisely controlled which allows the hydrodynamic force to be held substantially constant. This ability to reduce fluctuations in the hydrostatic pressure provides a resultant strip product of higher cross-sectional uniformity.

In the preferred embodiment shown in FIGS. 3 and 4, the electromagnetic containment zone 49 for initially shaping the molten material includes an inductor section 48 combined with an inductor section 50. The inductor section 48 has an inner surface 52 which faces the molten material and is generally flared outward to form a non-uniform cross section. Proceeding upwardly along the flared surface 52 of the inductor section 48, the current density gradually decreases as the current path increases. This effect is desirable because the molten material head height which is supported at each succeeding point outwardly along the flared surface 52 decreases correspondingly. The angle of inclination of the surface 52 is preferably selected with regard to the material being cast. The aim is to provide a substantial balance between the current magnitude in the inductor and the hydrostatic pressure exerted by the molten material at each point in the inductor section 48 of the containment zone.

The containment zone 49 may also include inductor section 50. The inductor section 50 has a flared surface 54 which is preferably abutted at one end to the lower edge of the flared surface 52. The other end of the surface 54 may be adjoined to a substantially vertical surface 56. As one proceeds downward along the flared surface 54, the current density increases as the current path decreases. This is necessary and desirable because the molten material head is correspondingly increasing. At the vertical surface 56, which is considered part of section 50, the current magnitude developed forces the molten material to neck down to the desirable shape which preferably has substantially the same cross-sectional shape as the desired thin strip shape 14.

The inductor sections 48 and 50 are herein described as together comprising the containment zone 49 for electromagnetically containing and forming the material in molten form into a cross-sectional shape substantially the same as the desired thin strip shape. Nevertheless, the inductor sections 48 and 50 may preferably be individually powered in order to reduce the power requirements needed to operate the electromagnetic casting apparatus 10, as described in U.S. Pat. No. 4,353,408 to Pryor, hereby incorporated as a reference. As mentioned above, with the high cross-sectional area towards the top surface of the sump, a lower frequency is required to contain the molten material in the desired shape. By way of example, a frequency on the kilohertz range may be required to maintain the molten material away from the flared surface 52, while a frequency in the megahertz range may be required along the flared surface 54 or the vertical surface 56 to contain and form the molten material as desired. To individually power the inductors, they are separated. To electrically separate the inductor sections 48 and 50, it may be desirable to employ an insulating gasket (not shown). The purpose of insulating the sections from each other is to provide independent powering of each section in order to tailor the current levels in the surfaces 52, 54 and 56. Tailoring the power applied to each section 48 and 50 may necessitate the employment of two separate power supplies and control systems (not shown). In this way, the current applied to the upper section 48 may be totally different from the current applied to the lower section 50. The difference in current results in corresponding differences in the magnetic field strengths of the respective sections. This allows for improved balancing of the desired magnetic forces provided by the inductors 48 and 50 and the hydrostatic pressures exerted by the material being cast. It is also within the scope of the present invention to combine inductor sections 48 and 50 and operate them with a single power supply and control system. The inductor lead connections (not shown) may be attached to the control system 34 and power source 35. Although the above-described electromagnetic casting system is suitable for forming and delivering molten thin strip material to the device 10 which provides edge control of the strip, it is also within the terms of the present invention to provide any desired apparatus to provide molten thin strip material.

Referring again to FIGS. 3 and 4, a device 10 receives the molten thin strip material from the apparatus 49 and reduces the distortion in the cross-sectional shape due to surface tension. The apparatus 10 electromagnetically forms molten thin strip material by generating controlled forces along the edges 26 and 28 of the strip to counteract the tendency of material pinch off. The apparatus includes inductors 18, 20, 30 and 32.

Loop-type inductors 18 and 20 are disposed on either side of the molten thin strip material for generating magnetic fields about the edges 26 and 28, respectively, of the molten thin strip material. They are preferably constructed of substantially rectangular current carrying coils which preferably have substantially identical configurations and are sized to be within the boundaries of the strip material. The coils may be windings of a multi-turn coil which is symmetrically split so that the thin strip material is sandwiched between the two windings. A single frequency supply 35 and control device 34 are preferably connected to the coils 18 and 20 by wire 29. The supply delivers a flow of current (indicated by arrows 66) into the coils so that the current flow through leg 64 is opposite to the direction of current flow in leg 68. Also, since coils 18 and 20 are connected in series, the current flow in leg 91 (see FIG. 4) of coil 20 is in the same direction as the current in leg 64 and the current flow in leg 93 is in the same direction as the current in leg 68. It is desirable to connect coils 18 and 20 to the same power supply 35 to substantially eliminate problems with phase relationships and synchronization. The coils 18 and 20 are positioned adjacent the flat sides 22 and 24 of the thin strip molten material with a minimum air gap. A small air gap increases the efficiency of the coupling of the magnetic fields with the molten material. Also, it is preferable to position the coils close to the edges 26 and 28 so that the current induced into the strip by the electric fields generated by the coil is close to the edge of the material. It is, however, within the scope of the present invention to geometrically shape the coils 18 and 20 to conform with the requirements dictated by the properties of the material being formed.

The apparatus 10 also includes inductors 30 and 32 which are preferably substantially identical single or multiple turn coils. They are disposed adjacent opposite edges 26 and 28, respectively, of the molten thin strip material. The coils 30 and 32 are preferably connected to the control 34 and power supply 35 by wires 71 and 73 whereby the current flows through legs 70 and 72 in opposite directions to the current flowing through the legs of the inner coils 18 and 20. Inductor coils 18, 20, 30 and 32 are preferably in phase with each other since they are all connected to the same power supply 35. The coils 30 and 32 are preferably positioned close to the edges of the thin strip material so as to provide good operating efficiency. Although these coils preferably have a rectangular cross section, as shown in FIG. 3, it is within the scope of the present invention to use other cross sections if desired.

Figure 5:
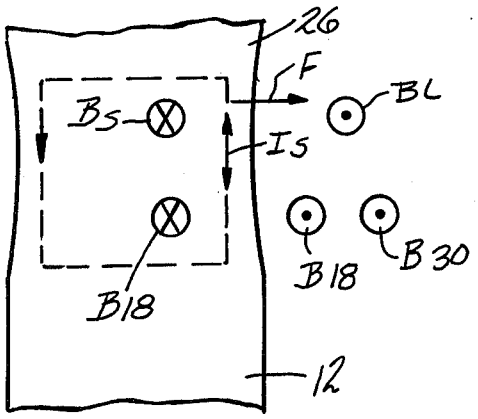
FIG. 5 is a view of the molten thin strip material with the fields, current and forces indicated thereon.

In order to more fully understand the shaping of the molten material, an explanation of the interaction between the fields generated by the inductors follows. Referring to FIG. 5, the molten thin strip 12 is illustrated with exemplary current and magnetic fields about edge 26 resulting from inductors 18, 20 and 30 provided thereon.

An image current $I_s$ is primarily induced in the molten strip substantially below the inductors 18 and 20 by the electric fields which they generate. The image current may also be induced by other factors such as inductor 30. The image current is induced with approximately a 180° phase shift from the current flow through inductors 18 and 20. With inductors 30 and 32 de-energized, the image current will reside under inductors 18 and 20. The net force in the image current electrons is substantially zero because the field strength on adjacent sides of $I_s$ are substantially equal and opposite. By applying current to inductors 30 and 32, the magnetic field strength increases on the outside edge of the image current loop for the following reasons.

A relatively strong magnetic field $B_{18}$ is generated by the inductor 18 and resides about the edges of the molten strip. For discussion purposes, only inductor 18 is considered. However, it should be remembered that the inductor 20 generates a magnetic field and image current that is additive to the magnetic field and image current generated by inductor 18. The current passing through the inductor 30 creates a magnetic field $B_{30}$ which is in the same direction as field $B_{18}$ in the adjacent air gap and, therefore, may be added to the latter. The resultant magnetic field $B_L$ located adjacent the edge 26 is equal to $B_{18}+B_{30}$. The field $B_{18}$ contained within the image current loop $I_s$ is in the opposite direction from the $B_{30}$ and the resultant field $B_s$ is equal to $B_{18}-B_{30}$. The resulting force F on the image current is substantially expressed by the formula:

$$F \alpha [B_L - B_s] \times I_s$$

F is proportional to $(B_L - B_s) \times I_s$ where

F is the force on the image current, $B_L$ is the resulting magnetic field on the edge side of the strip with respect to $I_s$, $B_s$ is the resulting magnetic field on the inner side of the strip with respect to $I_s$, and $I_s$ is the image current.

Since the magnetic field $B_L$ is larger than the field $B_s$, the resulting magnetic force moves the image current towards the edge. The control of this effect can be carried out by device 34 in combination with power source 35. The amount of current applied to the coils and/or frequency of current applied to the coils can be varied to change the magnitude of the fields and thereby the amount of pulling of the material either outward or inward. The fields can also be manipulated by changing the position of the coils with respect to the material, changing the number of coils or changing the shape of the coils as desired. Also, although the invention has been described in terms of controlling the edge forces so as to force the edges outward to maintain a substantially constant width strip, it is with the terms of the present invention to control the fields so that the resultant force is inward and the width of the strip is actually decreased and, if desired, in a non-uniform manner.

The power supply has the frequency preferably adjusted so that the electric fields generated by coils 18 and 20 have a penetration of one skin depth; approximately equal to one-half the strip thickness. This provides for a substantially uniform field and current throughout the thickness of the molten material and ultimately provides for more uniform control of the position of edges 26 and 28. It is, however, within the scope of the present invention to adjust the skin depth up to approximately five skin depths equals one-half the thickness of the sheet. The primary limitation here is that too much current may reside on the surface and prevent uniform pulling. The exact skin depth is ultimately determined by the physical properties and the geometry of the material being shaped.

To more fully understand the present invention, a description of its operation follows. The material may be electromagnetically formed into a desired thin strip shape by first delivering the material, such as silicon, in molten form to a large sump 42. The sump supports the material by an electromagnetic field generated by an inductor section 48. As the molten material moves towards the bottom of the sump, its transverse cross-sectional area reduces to substantially the desired thin strip shape. This shaping occurs substantially at the junction between the flared surface 54 and the vertical surface 56 of the inductor section 50. The electromagnetic force at the vertical surface 56 must be high enough to force the material to neck down to the desired shape. Generally, a very high frequency field is required to perform this function.

After the material is formed into the desired shape, it continues to move downstream. During this downstream movement, the tendency of the material is to continue necking down due to the surface tension forces acting in conjunction with the electromagnetic field which contains the molten material in the desired shape. To prevent the necking down and possible complete pinching off of the material, the molten thin strip material is received in a composite electro-magnetic field which reduces the distortion in the cross-sectional shape due to the surface tension. This composite electromagnetic field is provided by the interactions of the fields generated by inductors 18, 20, 30, and 32. The composite electromagnetic field preferably causes the edges of the molten strip to spread outward. The field can be regulated by varying the frequency, current, position and/or shape of the inductors.

Figure 6:
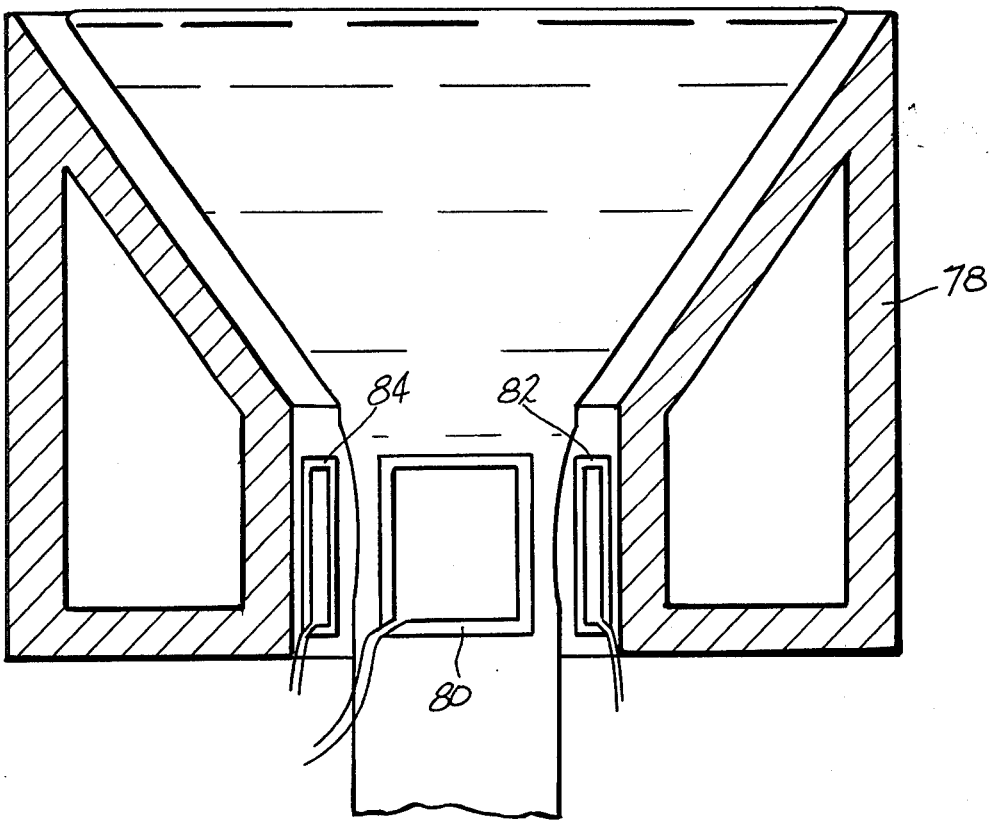
FIG. 6 is a side view of a second embodiment of the present invention.

A second embodiment is illustrated in FIG. 6. It is similar to FIG. 3 in that the strip is formed in an electromagnetic containment zone provided by inductor 78. Inductor 80 and a substantially identical inductor 80' behind inductor 80 (not shown) are similar to inductors 18 and 20, and inductors 82 and 84 are similar to inductors 30 and 32. The primary difference from FIG. 3 is that the inductors 80, 80', 82 and 84 for forming the desired thin strip shape are in the containment zone generated by inductor 78.

While the invention has been described generally by reference to silicon, it is applicable to a wide range of semi-conductor materials as well as various metals, metal alloys, metalloids, or semi-metal type materials which could find application in electronic devices. Further, the materials may be doped or undoped as desired.

Although the present invention has been generally described with a sump that is contained by an electromagnetic device such as an inductor, it is also within the scope of the present invention to substitute a crucible to hold the sump of material. The substitution, however, is a possibility which is not considered to be the preferred embodiment of the present invention but a workable alternative.

The U.S. patents and patent applications set forth in this application are intended to be incorporated by reference herein.

It is apparent that there has been provided in accordance with this invention a process and apparatus for electromagnetically forming a material into a desired thin strip shape which fully satisfies the objects, means, and advantages set forth hereinabove. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. In a casting apparatus comprising:

means for forming molten thin strip material having a thickness less than about 0.1" into a desired thin strip shape, said forming means comprising:

means for generating an image current loop near the edges of said molten strip, said image current loop generating means comprising:

means for generating first and second magnetic fields on either side of said molten thin strip material, each of said first and second magnetic fields interacting with said thin strip material to induce an image current into said molten strip which are additive to each other to induce said image current loop, said means for generating said first and second magnetic fields comprising first and second loop type inductors; and means for acting upon said image current loop near the first and second edges of said molten strip for creating a force which acts to increase the width of said strip, said force creating means comprising means for generating third and fourth magnetic fields, said third and fourth magnetic field generating means comprising respectively third and fourth inductors.

2. The apparatus as in claim 1 wherein said first and second loop type inductors are substantially identical.

3. The apparatus as in claim 2 wherein said third and fourth inductors are substantially identical.

4. The apparatus as in claim 3 further including a power supply means, said first and second inductors being electrically connected in series to said power supply means.

5. The apparatus as in claim 4 wherein said third and fourth inductors are powered by said power supply means whereby said first, second, third and fourth inductors are substantially in phase.

6. The apparatus as in claim 1 further including second means for forming said molten material into a thin strip having a cross-sectional shape substantially the same as said desired thin strip.

7. The apparatus as in claim 6 wherein said second forming means is disposed upstream and adjacent to said forming means.

8. The apparatus as in claim 6 wherein said forming means is disposed within the casting zone of said second forming means.

9. In a casting process, comprising the steps of:

forming molten thin strip material into a desired thin strip shape, having a thickness less than about 0.1 inches, said forming step comprising the steps of:

generating an image current loop near the edges of said molten thin strip, said image current loop generating step comprising the steps of:

providing first and second loop type inductors for generating first and second magnetic fields, disposing said first and second loop type inductors on either side of said molten thin strip material whereby each of said first and second magnetic fields interact with said thin strip material to induce first and second image currents into said molten strip which are added to each other to form said image current loop, acting upon said image current loop near the first and second edges of said molten strip for creating a force which acts to increase the width of said strip, said acting step including the step of providing third and fourth inductors for generating third and fourth magnetic fields to interact with said image current loop.

10. The process of claim 9 further including the step of regulating said first and second magnetic fields to be substantially equal.

11. The process of claim 10 further including the step of electrically connecting said first and second inductors in series.

12. The process of claim 11 including the step of setting the operating frequency used to power said first and second inductors so that said first and second magnetic fields each have a skin depth approximately equal to one-half the thickness of the molten thin strip material.

13. The process of claim 12 further including the step of varying the strengths of the third and fourth magnetic fields to vary the width of molten strip.

14. The process of claim 13 further including the step of maintaining a synchronous phase relationship between the first, second, third and fourth magnetic fields.

15. The process of claim 14 further including a further step of forming molten material into said thin strip wherein said thin strip has a cross-sectional shape substantially the same as the desired thin strip.

16. The process of claim 15 wherein the further step of forming said molten material occurs upstream and adjacent to the step of forming the molten thin strip material into the desired shape.

17. The process as in claim 16 wherein the step of forming molten thin strip material is concurrent with the further step of forming the molten material into molten thin strip.

* * * * *